United States Patent [19]

Locher

[11] 3,935,611

[45] Feb. 3, 1976

[54] BRUSH FOR THE CARE AND CLEANING OF THINGS AND THE BODY

[76] Inventor: Lorenz Locher, Kirchplatz 6, 7932 Munderkingen, Danube, Germany

[22] Filed: Mar. 1, 1974

[21] Appl. No.: 447,319

[30] Foreign Application Priority Data

Mar. 13, 1973 Germany ..... 2312318
Oct. 3, 1973 Germany ..... 2349580

[52] U.S. Cl. ..... 15/160; 15/144 R; 15/172
[51] Int. Cl.[2] ..... A46D 9/02
[58] Field of Search ..... 15/159, 160, 143, 144, 15/145, 167, 176, 187, 188, 201, 202, 206, 106, 164, 165, 172, 176, 210 R, 143 R, 144 R, 222

[56] References Cited

UNITED STATES PATENTS

| | | | |
|---|---|---|---|
| 1,532,522 | 4/1925 | Weaver, Jr. | 15/172 |
| 1,742,929 | 1/1930 | Ovtshenikoff | 15/160 |
| 2,154,831 | 4/1939 | Booharin | 15/222 X |
| 2,303,660 | 12/1942 | Schickel | 15/206 X |
| 2,464,321 | 3/1949 | Konczal | 15/143 R X |

FOREIGN PATENTS OR APPLICATIONS

| | | | |
|---|---|---|---|
| 13,540 | 8/1891 | United Kingdom | 15/106 |
| 460,724 | 2/1937 | United Kingdom | 15/210 R |

*Primary Examiner*—Peter Feldman
*Attorney, Agent, or Firm*—Ernest G. Montague; Karl F. Ross; Herbert Dubno

[57] ABSTRACT

A brush for the care and cleaning of things and the body and particularly for body massage, comprising a brush body shaped linearly and/or curved in order to fit an object to be treated, characterized by the fact that multiple-surface brush body is provided on at least two surfaces with a tipping, for instance of bristles, fibers, or the like whose properties with respect in particular to density, structure, hardness, material, and cut are different, on the two surfaces.

7 Claims, 10 Drawing Figures

B
D
1
C
2

F
G
1
E
H
3
2

1a
3
1b
1

2a
1d
K
3

1c
J
1c

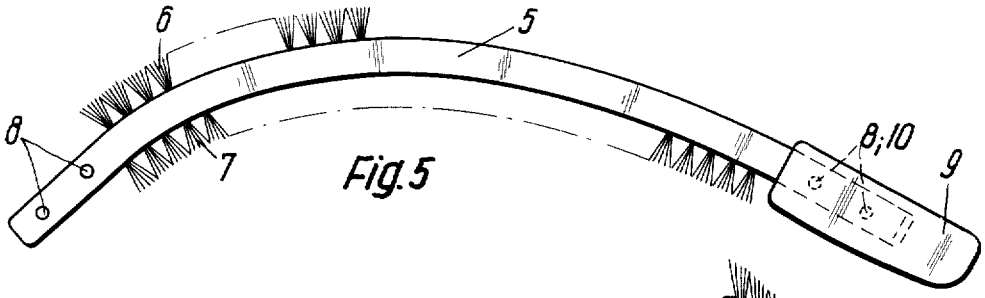
Fig.5
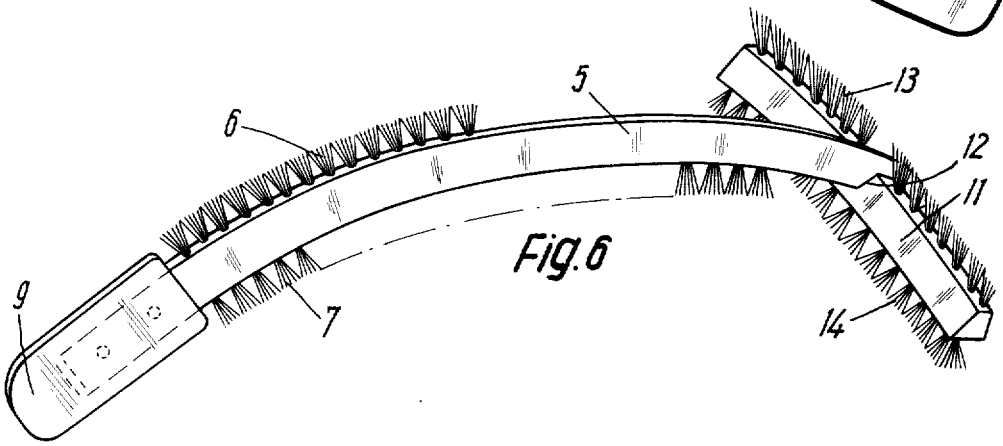
Fig.6
Fig.7
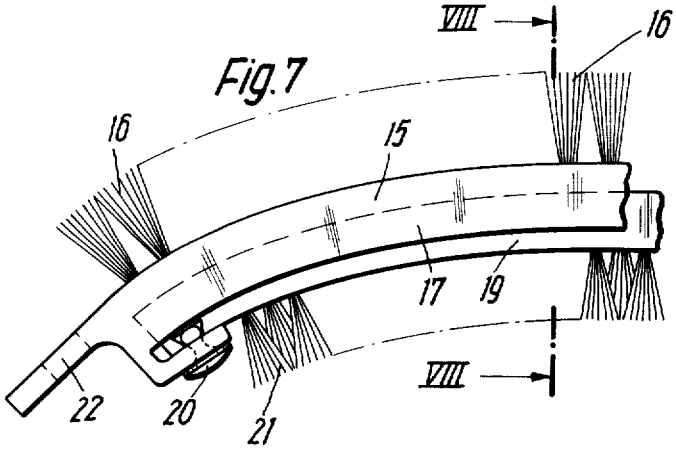
Fig.8
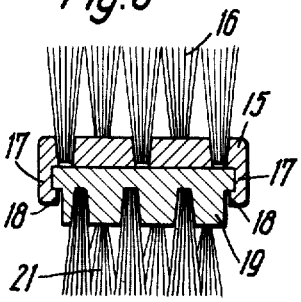
Fig.9
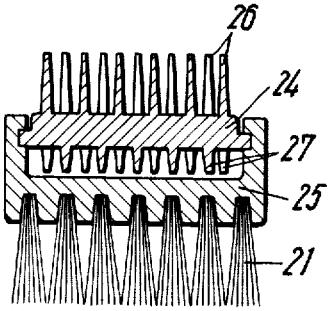

BRUSH FOR THE CARE AND CLEANING OF THINGS AND THE BODY

The present invention relates to a brush for the care of things and the body or for cleaning.

The present invention relates to brushes for care of things and the body or for cleaning, particularly for the massaging of the body, the brush bodies of which are shaped linearly and/or curved in order to fit the object to be treated.

The utility of such brushes depends primarily on the extent to which the brush can be adapted in its shape and function to the specific task of care or cleaning involved; the manner of handling same, its resistance to wear and the cost of manufacture and purchase are other important factors which are to be taken into account.

From these factors there results an object of the present invention which is to provide brushes for the care and cleaning of the body or of things which are so shaped with respect to the shape of the brush body as well as the shape, structure, and character of its bristles that they make possible a better, more diversified, and more effective use than previously and that as a result of this diversified use the cost of manufacture or purchase is also substantially less. In this way, particularly with reference to care of the body, the modern efforts to activate the circulation of the blood and care of the skin are taken into account more than previously.

The inventive concept resides in the fact that the brush body has a plurality of surfaces and is provided on at least two of its surfaces with a tipping, for instance, of bristles, fibers, or the like whose properties e.g. density, structure, hardness, material, and may be different on the two surfaces.

In this way a potentiation of the previous possibilities of combination is obtained which has the effect that a single brush which is substantially individually adapted to the individual conditions can be provided for practically all care and cleaning tasks. The advance to the art herein resides in particular in the fact that the increase in the types, does not necessarily result in an equal increase in the expense, since as a result of the means provided by the present invention and therefore, in particular, multiple working surfaces on a brush body and different type of tippings on a single body, there is obtained a reduction of the types of bristle carriers which has a favorable effect, in various respects, in view of the large demand for brushes for care and cleaning.

In this sense, it is also another object of the present invention to develop the brush body as an elongated S-shaped body which comprises one piece or is composed of several curved pieces, a part of the brush body or of the curved pieces being provided with bristles which extend opposite each other.

Furthermore, in accordance with the present invention the one curved part of the S-shaped brush body is provided on its convex side with several sections of coverings and bristles, some of which are concave and the others concave, linear, and/or convex, while on the concave side of the curved part there is provided a concave tipping and the other part of the curve can be employed as a handle.

Another possible variation in accordance with the present invention provided that the two curved parts of the S-shaped brush body are detachably assembled at the place of transition and can also be assembled in such a manner so as to produce an arc which extends continuously in one direction.

In accordance with the present invention, one or more uncovered areas of the brush body are provided in order to hold the brush, whereby handling can be improved.

It is advisable for manufacture and equipping if, in accordance with the present invention, the tipping carrier or brush body is made of preferably a flexible plastic material.

In accordance with the present invention, in order to arrange as many tufts or bundles of bristles in the brush body with only a small thickness of the body, the receiving holes for the fastening of the bristles in the brush body are arranged staggered relative to each other in longitudinal transverse directions in two bristle areas which are opposite each other.

In this way, despite the bilateral provision of the bristles there can be used brush bodies whose thickness need be only of the size for a single-sided provision of bristles, as a result of which a substantial savings in material is obtained, in addition to a reduction in weight, which is favorable for handling. Another advantage is that on each of the two surfaces of the brush body, very dense bristling per unit of surface can be arranged.

Furthermore, in accordance with the present invention, the cross section of the brush body is so designed that it can be flexibly deformed both concavely and convexly, and can be provided at both its ends with a flexible pull strap.

The possibility of adapting or adjusting the brush body to the prevailing existing conditions can be obtained in the manner that the brush body can be connected replaceably or exchangeably in form-lock manner with a holding body developed for handling, the parts to be connected being provided with fastening or detent means.

The nature of the covering and its effectiveness can be changed in the manner that the brush body is provided on one or both sides with a covering of rubber pins which are integral with the brush body. The brush body may in this connection suitably be provided with a holding device developed for the handling on which can be placed one or more additional brush bodies as an extension or protruding in trasverse direction.

The known tipping with rolled strips of crepe rubber, the intensive rubbing action of which affords advantageous possibilities of use can also be provided here. In this case the brush body must then be provided with continuous grooves for the pulling-in of the rolls of crepe rubber.

The above and other objects will become more readily apparent in the following detailed description of the present invention, in connection with the accompanying drawing, in which.

Figures 1, 2, 2A, 3, 4:
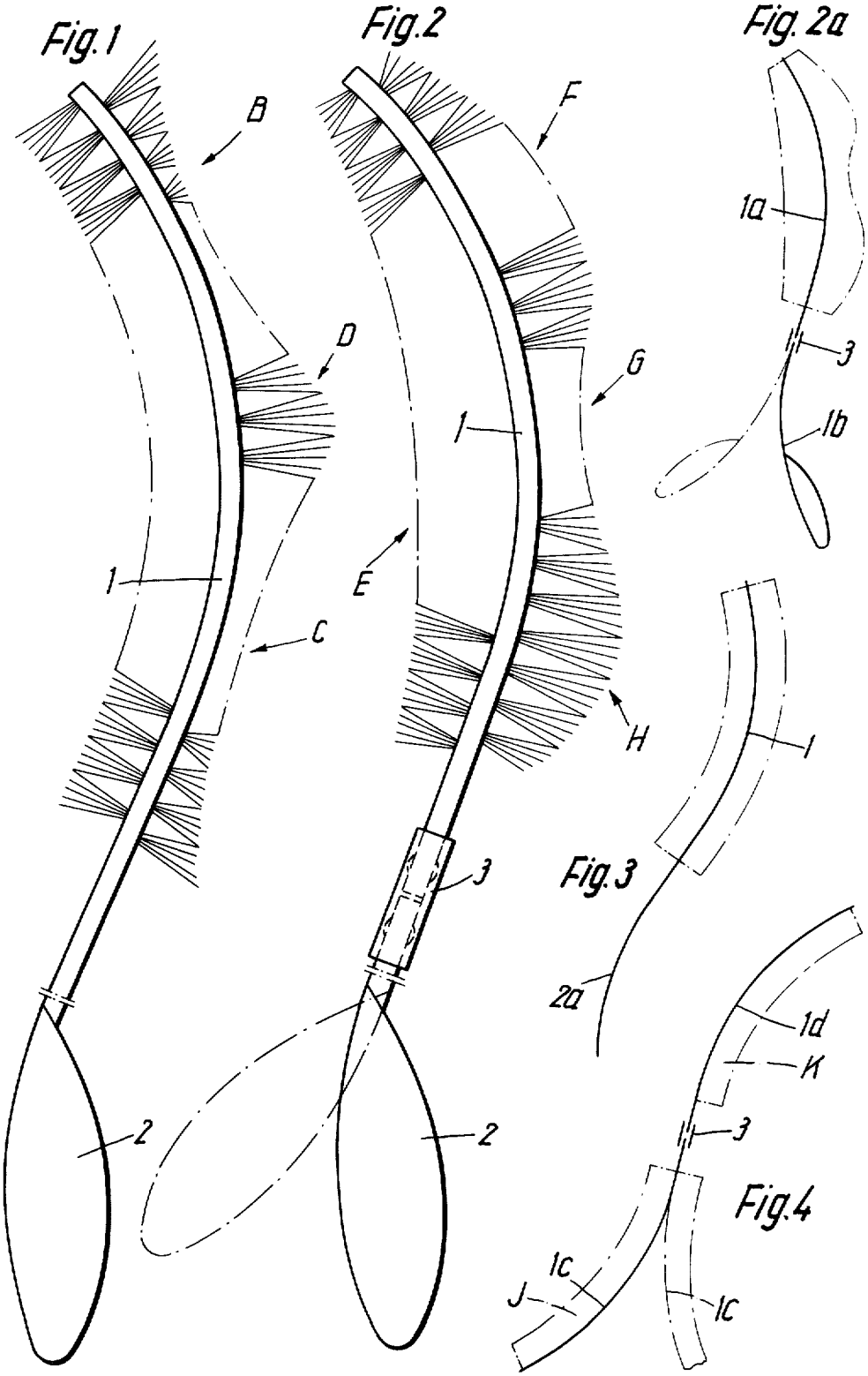
FIG. 1 is an elevation view showing the basic shape of the brush body.
FIG. 2 is an elevation view showing a variant of the bristle tipping.

FIG. 2*a* is an overall view of FIG. 2 on a smaller scale;

FIG. 3 is a partial elevation view on a smaller scale of an embodiment in accordance with FIG. 1 with parallel tipping with bristles;

FIG. 4 is an elevation view showing another development of the brush body on a smaller scale;

FIG. 5 is an elevation view showing a brush body of single curvature;

FIG. 6 is an elevation view showing a brush body with attachable brush body;

FIG. 7 is a partial elevational view of a brush body adapted to be pushed into place;

FIG. 8 is a section along the line VIII—VIII of FIG. 7; and

FIG. 9 is a cross-sectional view of a brush with mixed tipping.

The size of the brush shapes shown is independent of the dimensional ratios shown in the drawings. Since there are concerned here primarily brushes for proper care of the body and therefore in particular therapeutic treatment or massage, the dimension of the brush body will be determined essentially by the average size of the body of the user. In this connection it would be conceivable, while maintaining the basic shapes and embodiments, to provide a series of types for children and a series of types for adults. However, the size of the brush can be specifically selected also in the case of brushes for the cleaning of objects.

The universal brushes shown in FIGS. 1 and 2 comprise an S-shaped brush body 1 which is preferably made of flexible plastic and can be provided with a handle 2 at its one end.

In the case of the brush shown in FIG. 1, four different tippings A, B, C, D are provided, tipping A extending along an elongated concave curve, B in accordance with a strongly curved concave arc, C in accordance with a shallow concave arc, and D in accordance with a convex arc, of small radius. With these four forms it is possible to carry out a treatment program which covers the most important parts of the body since their basic shapes, stomach, chest, back, arms legs, etc. have to the greater part a convex curvature. Recesses in the body or special places of the surface of the body can be intensively treated with the tipping zone D.

A modification of the tippings is shown in the brush of FIG. 2. Here the tipping E extends in accordance with a flat concave arc, the tipping F in accordance with a flat convex arc, G concave, and H in accordance with a convex arc of stronger curvature. Since when treating concave or convex places of the body with convex and concave forms of tipping respectively the specific pressure between the body of the surface and the surface of the brush is greater than in the case of surfaces which correspond to each other, the brush in accordance with FIG. 2 is suitable, for intensive treatment and for cleaning so that this brush can be used both as bath brush and as massage brush.

FIG. 2*a* shows, in a smaller scale, the entire course of the S-shaped brush body, the two half-arcs 1*a* and 1*b* being approximately the same length. In FIGS. 2 and 2*a* there is furthermore shown the possibility of making the free half-arc part 1*b* removable by the use of a connecting socket 3 with detachable holding means (not shown) so that by swinging the part 1*b* there is obtained the shape of the brush body indicated in dashed line as a result of which the handling is facilitated in certain applications (for instance, massage of the back).

The particular suitability of the S-shape in accordance with the invention of the brush body is due to the fact that it corresponds to the anatomically determined lever movements of the arm and the hand and that there is present an elongated surface on which comparatively more tipping units can be arranged than in the case of a linear brush body.

In order to provide a small cross section of the brush body the bristle tufts 4 are arranged staggered with respect to each other, as can be noted from FIGS. 1 and 2.

FIG. 3 shows the relationships of the tipped brush body arc 1 with respect to the free arc part 2*a*. It can be noted herefrom that these parts should advisedly be made of about equal length. In FIG. 4 these conditions are shown in the case of a development in accordance with FIG. 2. In this case, furthermore, the half-arcs 1c and 1d are provided with the tipping J and K respectively on their concave side. Furthermore, these pieces can also be connected, for instance by the socket 3, so that the long arcuate shape shown in dashed lines can also be obtained. Since the half-arcs can also be tipped on both sides, such a half arc in itself produces a curved convenient massage brush of smaller size.

Other variants of curved brush bodies are shown in FIGS. 5, 6, 7, and 8. In FIG. 5 the brush body 5 is developed as an elongated arcuate bow which is provided on its narrow sides with the tippings 6 and 7 respectively. In this case the tipping 6 in the present example extends only over a part of the brush body and the tipping 7 over the greater part thereof. Furthermore, the tippings 6, 7 may be of the same type or else of different density or hardness. Because of its special shape this brush is particularly suited for the care of objects of large area and places which are poorly accessible and at a distance due to the length and narrowness of the brush.

The brush body can be used as handle, detent recesses 8 being provided on the ends and serving to hold a flexible slipover socket 9 firm by means of its projections 10.

Another improvement in the type of brush of FIG. 5 is shown in the example of FIG. 6. Here the brush body 5 is so arranged that further brush bodies, for instance a shorter body 11, can be removably attached to it. For this purpose the brush bodies 5 and 11 can each be provided with a recess 12 by means of which they can be pushed into each other and held fast. The transversely extending brush body 11 is provided on its bottom and top with tippings (bristles) 13 and 14 respectively. The diversified possibilities of use of this combination is readily clear.

In FIG. 7 and the section along the line VIII—VIII thereof shown in FIG. 8, there is shown an embodiment which is derived in particular from the embodiment of FIG. 5. In this case the actual brush body is developed as a flat flexible body 15 which bears the tipping 16. This brush body has flexible side strips 17 whose profile 18 permits the pushing thereof onto the rigid supporting body 19 and a form-locked connection with same. In order to fix it in longitudinal direction the brush body 15 can be fastened to the rigid carrying body by snap fasteners 20. The carrying body is provided with a tipping (bristles) 21. In this embodiment, therefore, the brush body 15 can be removed from the rigid supporting body 19 and used as flexible brush strip, for instance, for the massage of the body, holding tabs 22 having openings for a pull strap or other gripping devices being possibly provided for handling on the ends thereof.

In FIG. 9 still another possible development of the brush of FIGS. 7 and 8 is shown. In this case the brush body 24 made of rubber is inserted in removable manner in a rigid support body 25 and is provided on both sides with tippings 26, 27 which consist of integral rubber pins, in which case the tipping 27 can be harder than the tipping 26. The rigid supporting body 25 can also be tipped.

The proposals of the present invention which have been shown and described result in an extremely large possibility of variation with respect to the shaping of the tipping surface and the type of tipping, so that the program for the use of the desired universal brush far exceeds that of the brushes heretofore known.

As has already been mentioned, in this connection the size of brush can, during manufacture, be adapted to the purpose of use while maintaining the desired shape.

In this connection mention should be made of the equally important passive and particularly therapeutic use, namely, treatment for instance by a nurse. This type of treatment may also be permitted by the shapes of brushes in accordance with the invention due to their diversity, it being possible to provide the brush body at suitable places, for instance between the half-arcs, with a bow-shaped handle or some other holding device.

While I have disclosed several embodiments of the present invention, it is to be understood that these embodiments are given by example only, and not in a limiting sense.

I claim:

1. A body-cleaning and massage brush comprising:

an elongated arcuate flexible body of flattened cross-section having a pair of parallel oppositely turned faces;

first and second brush means of different textures on said faces covering same and projecting outwardly therefrom, at least one of said brush means having at least one concave contour and at least one convex contour;

a curved handle for manipulating said body; and detent means for releasably mounting said handle on one end of said body in a selected one of two positions whereby in one of said positions said brush has a generally S-shaped configuration and in the other position said brush has a continuous arcuate curvature corresponding to the curvature of said body.

2. A body-cleaning and massage brush comprising:

an elongated arcuate body of flattened cross-section having a pair of parallel oppositely turned faces;

first and second brush means of different textures on said faces covering same and projecting outwardly therefrom, at least one of said brush means having at least one concave contour and at least one convex contour;

a curved handle for manipulating said body; and means for mounting said handle on one end of said body in a position in which said brush has a generally S-shaped configuration.

3. The body-cleaning and massage brush defined in claim 2 wherein said body is flexible.

4. The body-cleaning and massage brush defined in claim 2 wherein said means for mounting said handle on said one end of said body includes a detent means defining two relative positions of said handle and said body, said brush having said generally S-shaped configuration in one of said positions and said brush having a continuous arcuate curvature corresponding to the curvature of the body in a second of said positions.

5. The body-cleaning and massage brush defined in claim 2 wherein at least one of said brush means consists of bristles.

6. The body-cleaning and massage brush defined in claim 2 wherein said body consists of a single piece.

7. The body-cleaning and massage brush defined in claim 2 wherein said body consists of a pair of arcuate pieces attached in end-to-end relationship.

* * * * *